US008328569B2

(12) United States Patent
Roscizewski et al.

(10) Patent No.: US 8,328,569 B2
(45) Date of Patent: Dec. 11, 2012

(54) ADAPTER FOR COUPLING A DEADBREAK BUSHING TO A DEADBREAK ARRESTOR ELBOW

(75) Inventors: Paul Michael Roscizewski, Eagle, WI (US); David Charles Hughes, Rubicon, WI (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 13/112,318

(22) Filed: May 20, 2011

(65) Prior Publication Data

US 2011/0287652 A1 Nov. 24, 2011

Related U.S. Application Data

(60) Provisional application No. 61/347,216, filed on May 21, 2010.

(51) Int. Cl.
*H01R 13/53* (2006.01)

(52) U.S. Cl. ..... 439/187

(58) Field of Classification Search ..... 439/181–187, 439/358, 507, 784, 805
See application file for complete search history.

(56) References Cited

U.S. PATENT DOCUMENTS

| | | | | |
|---|---|---|---|---|
| 3,768,065 | A * | 10/1973 | Zemels | 439/603 |
| 3,876,280 | A * | 4/1975 | Jones et al. | 439/750 |
| 4,154,993 | A * | 5/1979 | Kumbera et al. | 200/50.24 |
| 5,201,666 | A * | 4/1993 | Markham | 439/186 |
| 6,042,407 | A | 3/2000 | Scull et al. | |
| 6,132,234 | A * | 10/2000 | Waidner et al. | 439/358 |
| 7,503,785 | B2 * | 3/2009 | Stepniak | 439/187 |
| 2006/0051999 | A1 * | 3/2006 | Allemann et al. | 439/320 |
| 2007/0141882 | A1 | 6/2007 | Stepniak | |
| 2008/0096419 | A1 | 4/2008 | Purdy et al. | |
| 2008/0227342 | A1 | 9/2008 | Luzzi | |
| 2009/0215321 | A1 | 8/2009 | Hughes | |
| 2009/0253286 | A1 * | 10/2009 | Tanaka et al. | 439/329 |
| 2010/0068907 | A1 | 3/2010 | Meyer et al. | |

FOREIGN PATENT DOCUMENTS

WO 2006052604 A1 5/2006

OTHER PUBLICATIONS

The International Search Report for corresponding international application No. PCT/US2011/037317, mailed Jul. 20, 2011.
Tyco Electronics; New Product Bulletin / Energy Division; "ELB-35-600-ARSTR, 35 kV 600A T-Body Elbow Arrester"; Apr. 2009, Copyright 2009; 2 sheets.

* cited by examiner

*Primary Examiner* — Chandrika Prasad
(74) *Attorney, Agent, or Firm* — King & Spalding LLP

(57) ABSTRACT

An adapter for connecting a 600 ampere deadbreak bushing to a pull-on and pull-off deadbreak elbow used for normally non-current carrying applications. The adapter comprises a two part separable assembly having first and second ends. The first end is threaded to mate with a threaded opening in the deadbreak bushing and the second end is threaded to mate with a threaded opening in a lug of the deadbreak elbow. The two part separable assembly is coupled together with the first part of the assembly that is screwed into the deadbreak bushing and has a groove that snaps (latches) into a corresponding latching ring in a molded insert of the deadbreak elbow that surrounds the second part of the assembly screwed into the lug inside of the deadbreak elbow. Other latching mechanisms may be used to mechanically and electrically couple together the first and second parts of the adapter assembly.

19 Claims, 3 Drawing Sheets

ADAPTER FOR COUPLING A DEADBREAK BUSHING TO A DEADBREAK ARRESTOR ELBOW

RELATED PATENT APPLICATION

This application claims priority to commonly owned U.S. Provisional Patent Application Ser. No. 61/347,216; filed May 21, 2010; entitled "Adapter for Bushing Latch," by Paul Michael Roscizewski and David Charles Hughes; and is hereby incorporated by reference herein for all purposes.

TECHNICAL FIELD

The present invention relates generally to medium voltage connectors for dead front electrical equipment, and more particularly, to an adapter for interfacing a stab-on type arrestor elbow connector to a 600 ampere rated deadbreak bushing connector in the medium voltage electrical equipment.

BACKGROUND

In a typical power distribution network, substations deliver electrical power to consumers via interconnection cables and electrical apparatuses, e.g., transformers, switches, circuit breakers, fuses, etc. The cables terminate on bushings passing through walls of metal encased equipment, such as capacitors, transformers, switchgear, etc. Increasingly, this equipment is "dead front," meaning that the equipment is configured such that an operator cannot make contact with any live electrical parts. Dead front systems have proven to be safer than "live front" systems, with comparable reliability and low failure rates.

Various safety codes and operating procedures for underground power systems require a visible disconnect between each cable and electrical apparatus to safely perform routine maintenance work, such as line energization checks, grounding, fault location, and hi-pot testing. One approach to meeting this requirement for a dead front electrical apparatus is to provide a "separable connector system" including a first connector assembly connected to the apparatus and a second connector assembly connected to an electric cable. The second connector assembly is selectively positionable with respect to the first connector assembly. An operator can engage and disengage the connector assemblies to achieve electrical connection or disconnection between the apparatus and the cable.

Generally, one of the connector assemblies includes a female style connector, and the other one of the connector assemblies includes a corresponding, male style connector. During a typical operation for making an electrical connection, an operator slides a female style connector over its corresponding male style connector. In some cases, each of the connector assemblies can include two connectors. For example, one of the connector assemblies can include ganged, substantially parallel female style connectors, and the other of the connector assemblies can include substantially parallel male style connectors that correspond to and are aligned with the female style connectors.

In general, two basic types of separable connector systems have conventionally been provided, namely, deadbreak connector systems and loadbreak connector systems. Deadbreak connector systems require connection or disconnection of cables while the equipment and the cables are de-energized. That is, deadbreak connectors are mated and separated only when there is no voltage present at and load current flowing through the connectors. A bolted connection is made such that the cable connector is screwed into the bushing with a coupling bolt in, e.g., a T-body 600 A deadbreak elbow. Deadbreak connector systems for high voltage equipment are typically rated for currents of 600 amperes.

To avoid power interruptions required by deadbreak connector systems, loadbreak connector systems have been developed that allow connection and disconnection to equipment when operating voltage and load current are present. This is done with a special arc interrupting probe tip in the loadbreak elbow. Loadbreak connector systems, however, are typically rated for much lower currents (typically about 200 amperes) than deadbreak connector systems.

The loadbreak elbow connector comprises an insulated portion having a recessed inner conical opening, a threaded lug, and a loadbreak probe with an arc follower tip portion. The loadbreak probe is screwed into the threaded lug coaxially within the inner conical opening. The loadbreak probe is made from a conductive material that contacts corresponding finger contacts into a mating loadbreak bushing connector to complete a circuit that includes the loadbreak elbow and the mating loadbreak connector. When mated together, an end of the male type conically shaped bushing connector is disposed substantially within the recessed inner conical opening of the loadbreak elbow. In this recessed inner conical opening, the loadbreak elbow includes a locking ring that is molded into the body of the loadbreak elbow connector that keeps the loadbreak elbow mechanically coterminous with the mating loadbreak male type bushing connector (e.g., loadbreak bushing). To connect and disconnect the loadbreak connectors, a person can manipulate the arrestor elbow onto and off of the male connector (e.g., loadbreak bushing) by using a liveline tool or "hot stick" in an operating eye of the loadbreak elbow to push on or pull off the loadbreak elbow with the loadbreak bushing The different mechanical and electrical mating interfaces of the 600 A deadbreak and 200 A loadbreak connectors are not compatible with one another, however, both use similar insulated mechanical conical portions of the male bushing and female elbow.

Transformers used in wind farm applications are generally equipped with 600 A deadbreak bushings. To obtain over voltage protection for the system, elbows having lightning or surge arrestors built-in ("arrestor elbows") are attached to the transformer bushings. Traditionally, companies have only offered arrestors in 200 A loadbreak elbows, which, as set forth above, cannot be directly coupled to the 600 A deadbreak bushings. To compensate for this, companies have coupled intermediary connector adapters, such as an extender in combination with a loadbreak reducing tap plug (LRTP), between the standard 600 A deadbreak bushings and the 200 A arrestor loadbreak elbows. This approach is not desirable at least because the extra pieces required increase the cost of the installation and increase deadfront spacing requirements for this type of 600 A bushing—LRTP adapter-200 A arrestor elbow configuration.

SUMMARY

Therefore, what is needed is a less expensive and more compact adapter for interfacing a deadbreak 600 A bushing with a pull-on and pull-off arrestor elbow when used for normally non-current carrying applications, e.g., lightning and surge arrestors. This may be accomplished, according to the teachings of this disclosure, by providing an adapter for connecting a specially designed deadbreak elbow to the 600 ampere deadbreak bushing, configured in a form factor similar to a 200 ampere loadbreak elbow. This adapter comprises a two part separable assembly having first and second ends.

The first end is threaded to mate with a threaded opening in the deadbreak bushing and the second end is threaded to mate with a threaded opening in a lug of the deadbreak elbow. The two part separable assembly is coupled together with the first part of the assembly that is screwed into the deadbreak bushing and has a groove that snaps (latches) into a corresponding latching ring in a molded insert of the deadbreak elbow that surrounds the second part of the assembly screwed into the lug inside of the deadbreak elbow. Other latching mechanisms may be used to mechanically and electrically couple together the first and second parts of the adapter assembly, e.g., barb and groove, latch ring, etc. The adapter assembly may also be spring loaded for increased electrical contact pressure (lower connection resistance).

According to a specific example embodiment of this disclosure, an adapter for coupling together a deadbreak bushing and a mating push-on/pull-off deadbreak arrestor elbow, comprises: a probe having a threaded end and a contact end opposite the threaded end thereof; and a socket having a threaded end and a contact end opposite the threaded end thereof; wherein: the threaded end of the probe screws into a connector in a deadbreak arrestor elbow, the threaded end of the socket screws into a threaded opening in a deadbreak bushing, and when the deadbreak arrestor elbow is placed onto the deadbreak bushing and forced thereover, the probe and socket contact ends make electrical and mechanical connection therebetween.

According to another specific example embodiment of this disclosure, an adapter for coupling together a deadbreak bushing and a mating deadbreak arrestor elbow comprises: a deadbreak probe having a threaded end and a contact end opposite the threaded end thereof; and a socket having a threaded end, a contact end opposite the threaded end thereof and a latching ring groove on an outside circumference of the socket and substantially coterminous with the contact end thereof; wherein: the threaded end of the non-loadbreak probe screws into a connector in a deadbreak arrestor elbow, the threaded end of the socket screws into a threaded opening in a deadbreak bushing, when the deadbreak arrestor elbow is placed onto the deadbreak bushing and forced thereover, the probe and socket contact ends make electrical connection therebetween, and wherein the latching ring groove fits onto a latching ring at an end of a conical opening of the deadbreak arrestor elbow, whereby the deadbreak bushing and the deadbreak arrestor elbow are thereby mechanically held together.

According to yet another specific example embodiment of this disclosure, a method of coupling together a deadbreak bushing and a mating deadbreak arrestor elbow comprises the step of: screwing a deadbreak probe into a connector in a deadbreak arrestor elbow; screwing a deadbreak socket into a treaded opening in a deadbreak bushing; and pushing the deadbreak arrestor elbow onto the deadbreak bushing, wherein the deadbreak probe and deadbreak socket make electrical and mechanical connection therebetween.

BRIEF DESCRIPTION OF THE DRAWINGS

For a more complete understanding of the present invention and the advantages thereof, reference is now made to the following description, in conjunction with the accompanying drawings briefly described as follows.

Figure 1:
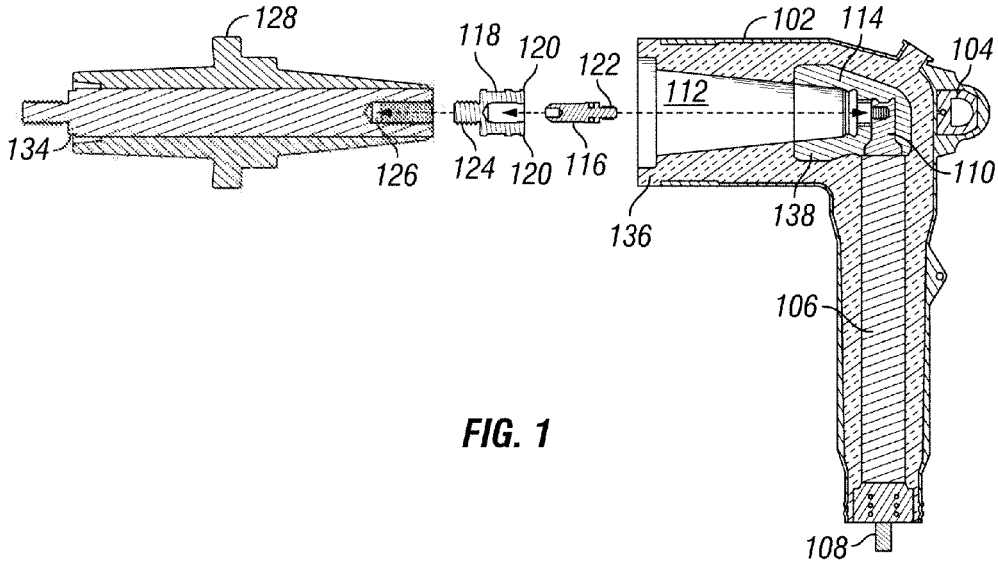
FIG. 1 illustrates a schematic elevational exploded view of a cross section of a 600 A deadbreak bushing, push-on/pull-off deadbreak arrestor elbow and adapter therebetween, according to a specific example embodiment of this disclosure.

While the present disclosure is susceptible to various modifications and alternative forms, specific example embodiments thereof have been shown in the drawings and are herein described in detail. It should be understood, however, that the description herein of specific example embodiments is not intended to limit the disclosure to the particular forms disclosed herein, but on the contrary, this disclosure is to cover all modifications and equivalents as defined by the appended claims.

DETAILED DESCRIPTION

Referring now to the drawings, details of specific example embodiments of the present invention are schematically illustrated. Like elements in the drawings will be represented by like numbers, and similar elements will be represented by like numbers with a different lower case letter suffix.

Referring to FIG. 1, depicted is a schematic elevational exploded view of a cross section of a 600 A bushing, push-on/pull-off deadbreak arrestor elbow and adapter therebetween, according to a specific example embodiment of this disclosure. A conventional deadbreak male type connector commonly known in the industry as a "600 A deadbreak bushing" is represented by the numeral 128. The bushing 128 includes an opening 126 having an internal 5/8-11 thread, which is configured for mechanically connecting to a corresponding threaded bolt of a mating connector (not shown), e.g., T-body or T-head elbow, whereby the bushing 128 and mating T-body connector (not shown) are both mechanically and electrically joined together. To connect and disconnect these types of 600 A deadbreak connectors, the threaded bolt assembly in the T-body elbow (not shown) is rotated until the threaded bolt is unscrewed from the threaded opening in the bushing 128. Then the T-body elbow (not shown) may be removed from the 600 A deadbreak bushing 128 that is normally mounted on a dead front electrical equipment panel (not shown).

A push-on/pull-off deadbreak arrestor elbow is represented by the numeral 102. This deadbreak arrestor elbow 102 comprises a molded EPDM insulation body 136 enclosing an electrical connector 110 having a threaded hole at an end opposite an attached surge or lightning arrestor 106, an insulated pulling eye 104 is attached to the outside of the body 136 of the deadbreak arrestor elbow 102 in line with a conical opening 112 in the body 136. The conically shaped opening 112 of the deadbreak arrestor elbow 102 is adapted to fit over the conically shaped bushing 128. The bushing latch adapter, according to the teachings of this disclosure, allows for coupling the deadbreak arrestor elbow 102 to the standard 600 A deadbreak bushing 128 without requiring an additional load-break reducing tap plug (LRTP)(not shown). The surge or lightning arrestor 106 is connected to ground through a grounding wire 108.

The bushing latch adapter of FIG. 1 comprises a short non-loadbreak probe 116 and a mating socket 118. The probe 116 has a threaded end 122 that screws into the connector 110, and the socket 118 has a threaded end 124 that screws into the opening 126 of the bushing 128. It is contemplated and within the scope of this disclosure that the socket 118 may or may not be spring loaded, and the probe 116 may be of a barb design for being held better in the socket 118, or smooth for easily sliding into the socket 118.

The probe 116 may be preassembled with the connector 110 in the deadbreak arrestor elbow 102 at the factory or in the field, and the socket 118 installed in the field on an existing 600 A bushing 128. The socket 118 may have a latching ring groove 120 on an outside circumference of the end opposite the threaded end 124, and be adapted to mate with a latching ring 114 molded into a semi-conductive insert 138 located inside of the insulated deadbreak arrestor elbow 102. The latching ring 114 and the latching ring groove 120 mechanically engage and securely hold together the probe 116 and socket 118.

To connect the bushing 128 and the deadbreak arrestor elbow 102 together, an electrician pushes the deadbreak arrestor elbow 102 onto the bushing 128 with a hot stick or liveline (not shown)(via the operating or pulling eye 104) so that the groove 120 engages the latching ring 114. An interference fit or "latching force" between the groove 120 and the latching ring 114 securely and mechanically mates the bushing 128 and deadbreak arrestor elbow 102 together when the bushing 128 and deadbreak arrestor elbow 102 are electrically connected together. To disconnect the bushing 128 and deadbreak arrestor elbow 102, the electrician pulls the deadbreak arrestor elbow 102 off of the bushing 128 with the hot stick or liveline (not shown)(via the operating eye 104), with sufficient force to overcome the latching force between the groove 120 and latching ring 114. A person of ordinary skill in the art and having the benefit of the present disclosure will recognize that many other alternative latching mechanisms may be used, and are contemplated herein.

Figure 2:
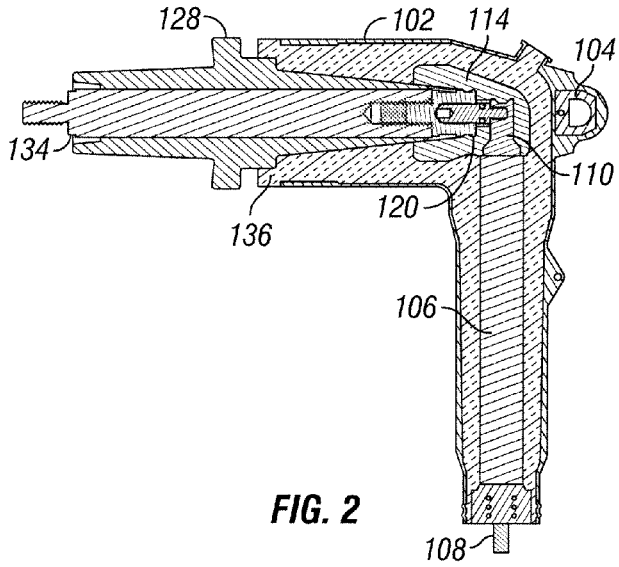
FIG. 2 illustrates a schematic elevational assembled view of a cross section of a mated 600 A bushing, push-on/pull-off deadbreak arrestor elbow and adapter therebetween as shown in FIG. 1, according to the specific example embodiment of this disclosure.

Referring to FIG. 2, depicted is a schematic elevational assembled view of a cross section of a 600 A bushing, push-on/pull-off deadbreak arrestor elbow and adapter therebetween shown in FIG. 1, according to the specific example embodiment of this disclosure. The bushing 128 and elbow 102 are coupled together as shown and remain securely together with the mechanical cooperation of the groove 120 and latching ring 114.

Figure 3:
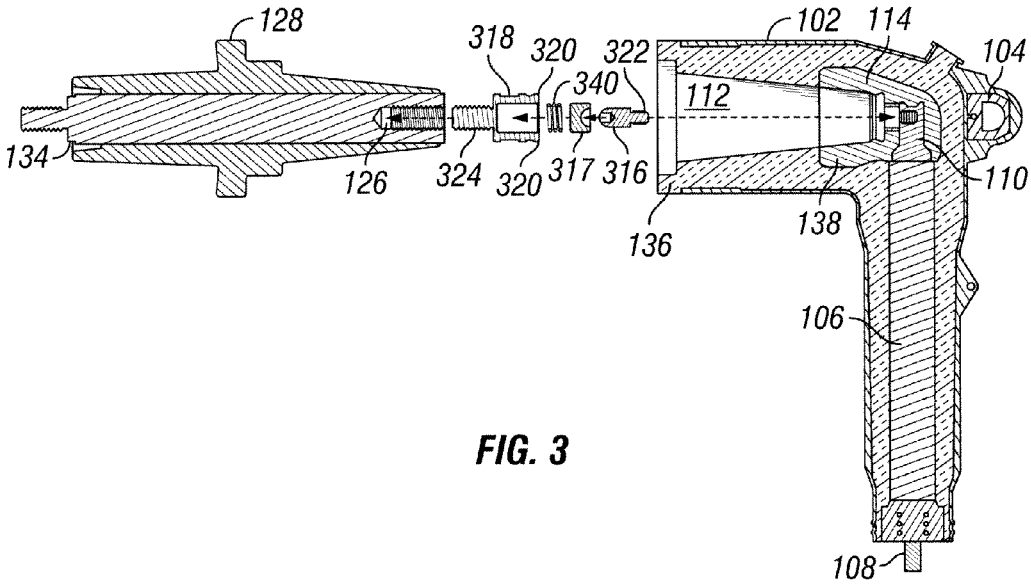
FIG. 3 illustrates a schematic elevational exploded view of a cross section of a 600 A deadbreak bushing, push-on/pull-off deadbreak arrestor elbow and adapter therebetween, according to another specific example embodiment of this disclosure.

Referring to FIG. 3, depicted is a schematic elevational exploded view of a cross section of a 600 A bushing, push-on/pull-off deadbreak arrestor elbow and adapter therebetween, according to another specific example embodiment of this disclosure. The bushing 128 and elbow 102 are the same as those described in FIG. 1 hereinabove. The bushing latch adapter of FIG. 3 comprises a short non-loadbreak probe 316, and a mating socket 318 having a slideable electrical contact 317 and a loading spring 340 therein. The probe 316 has a threaded end 322 that screws into the connector 110, and the socket 318 has a threaded end 324 that screws into the opening 126 of the bushing 128. The loading spring 340 is used for biasing the slideable electrical contact 317 toward a contact end of the probe 316 for reducing electrical contact resistance therebetween.

The probe 316 may be preassembled with the connector 110 in the deadbreak arrestor elbow 102 at the factory or in the field, and the socket 318 installed in the field on an existing 600 A bushing 128. The socket 318 may have a latching ring groove 320 on an outside circumference of the end opposite the threaded end 324, and be adapted to mate with a latching ring 114 molded into a semi-conductive insert 138 located inside of the insulated deadbreak arrestor elbow 102. The latching ring 114 and the latching ring groove 320 mechanically engage and securely hold together the probe 316 and socket 318.

Figure 4:
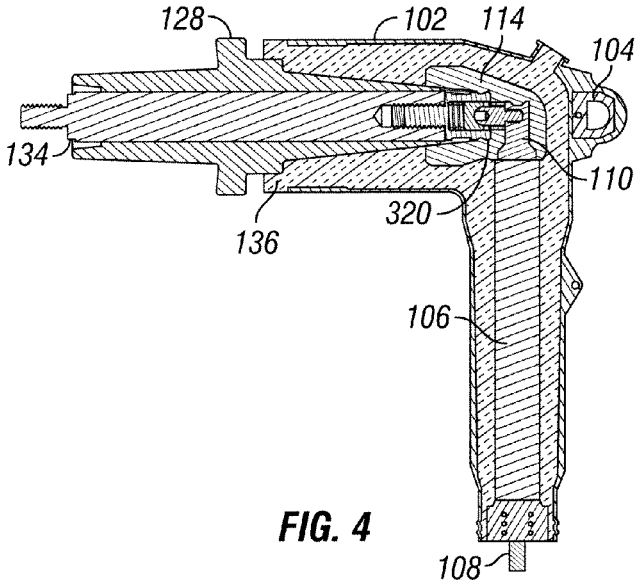
FIG. 4 illustrates a schematic elevational assembled view of a cross section of a mated 600 A bushing, push-on/pull-off deadbreak arrestor elbow and adapter therebetween shown in FIG. 3, according to the another specific example embodiment of this disclosure.

Referring to FIG. 4, depicted is a schematic elevational assembled view of a cross section of a 600 A bushing, push-on/pull-off deadbreak arrestor elbow and adapter therebetween shown in FIG. 3, according to the another specific example embodiment of this disclosure. The bushing 128 and elbow 102 are coupled together as shown and remain securely together with the mechanical cooperation of the groove 320 and latching ring 114. In addition, the loading spring 340 biases the slideable electrical contact 317 toward a contact end of the probe 316 for reducing electrical contact resistance therebetween.

Figure 5:
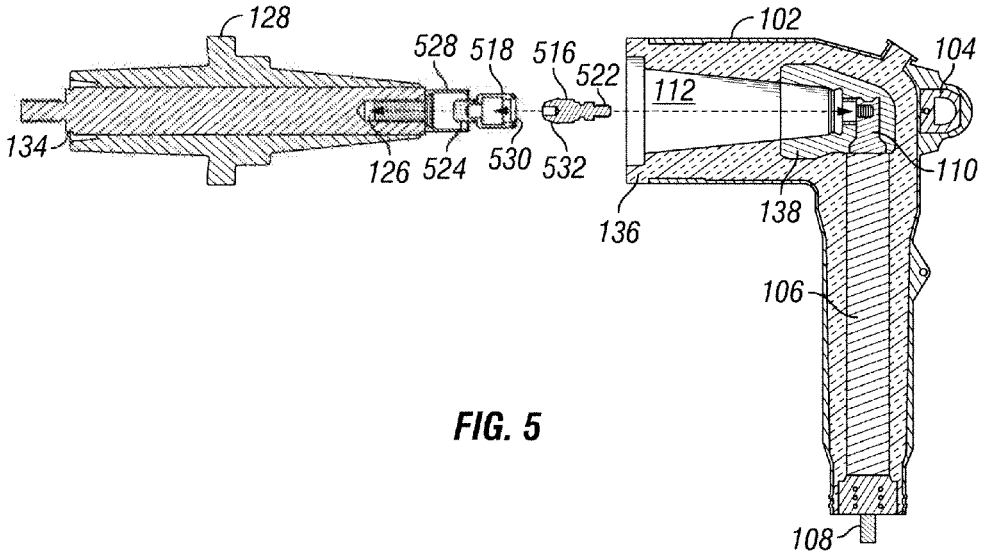
FIG. 5 illustrates a schematic elevational exploded view of a cross section of a 600 A deadbreak bushing, push-on/pull-off deadbreak arrestor elbow and adapter therebetween, according to yet another specific example embodiment of this disclosure.

Referring to FIG. 5, depicted is a schematic elevational exploded view of a cross section of a 600 A bushing, push-on/pull-off deadbreak arrestor elbow and adapter therebetween, according to yet another specific example embodiment of this disclosure. The bushing 128 and elbow 102 are the same as those described in FIG. 1 hereinabove. The bushing latch adapter of FIG. 5 comprises a short non-loadbreak probe 516. The probe 516 has a threaded end 522 that screws into the connector 110, and the socket 518 has a threaded end 524 that screws into the opening 126 of the bushing 128. The probe 516 is configured into a barb shape at end 532 that mechanically cooperates with an internal latching ring 530 inside of the opening of the socket 518 to mechanically hold the probe 516 and socket 518 together when the elbow 102 is forced over the bushing 128.

The probe 516 may be preassembled with the connector 110 in the deadbreak arrestor elbow 102 at the factory or in the field, and the socket 518 installed in the field on an existing 600 A bushing 128. The socket 518 has a latching ring 530 on an inside circumference of the end opposite the threaded end 524, and is adapted to mate with a barbed portion of the probe 516. The latching ring 530 and the barbed portion of the probe 516 mechanically engage and securely hold together the probe 516 and socket 518. A biasing collar 528 may further be used to increase compressive tension between the latching ring 530 and the barbed portion of the probe 516.

Figure 6:
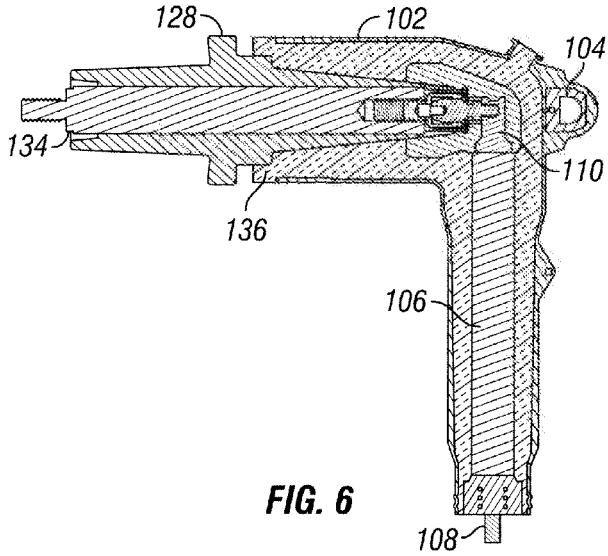
FIG. 6 illustrates a schematic elevational assembled view of a cross section of a mated 600 A bushing, push-on/pull-off deadbreak arrestor elbow and adapter therebetween shown in FIG. 5, according to the yet another specific example embodiment of this disclosure.

Referring to FIG. 6, depicted is a schematic elevational assembled view of a cross section of a 600 A bushing, push-on/pull-off deadbreak arrestor elbow and adapter therebetween shown in FIG. 5, according to the yet another specific example embodiment of this disclosure. The bushing 128 and elbow 102 are coupled together as shown and remain securely together with the mechanical cooperation of the latching ring 530 and the barbed portion of the probe 516.

Although specific example embodiments of the invention have been described above in detail, the description is merely for purposes of illustration. It should be appreciated, therefore, that many aspects of the invention were described above by way of example only and are not intended as required or essential elements of the invention unless explicitly stated otherwise. Various modifications of, and equivalent steps corresponding to, the disclosed aspects of the exemplary embodiments, in addition to those described above, can be made by a person of ordinary skill in the art, having the benefit of this disclosure, without departing from the spirit and scope of the invention defined in the following claims, the scope of which is to be accorded the broadest interpretation so as to encompass such modifications and equivalent structures.

We claim:

1. An adapter for coupling together a deadbreak bushing and a mating push-on/pull-off deadbreak arrestor elbow, said adaptor comprising:

a probe having a threaded end and a contact end opposite the threaded end thereof; and a socket having a threaded end and a contact end opposite the threaded end thereof;

wherein:

the threaded end of the probe screws into a connector in a deadbreak arrestor elbow, the threaded end of the socket screws into a threaded opening in a deadbreak bushing, and when the deadbreak arrestor elbow is placed directly onto the deadbreak bushing and forced thereover, the probe and socket contact ends make electrical and mechanical connection therebetween.

2. The adapter according to claim 1, further comprising a latching ring groove on an outside circumference of the socket and substantially coterminous with the contact end of the socket, wherein the latching ring groove fits onto a latching ring at an end of a conical opening of the deadbreak arrestor elbow, whereby the bushing and elbow are thereby mechanically held together.

3. The adapter according to claim 1, further comprising a spring biased electrical contact slideably located in the socket for reducing electrical resistance between the socket and probe when coupled together.

4. The adapter according to claim 1, wherein the probe is smooth for reducing force required when being inserted into the socket.

5. The adapter according to claim 1, wherein the probe is barbed and the barbs further improve mechanical holding when the probe is inserted into the socket.

6. The adapter according to claim 1, wherein the probe is barb shaped and mechanically cooperates with an internal latching ring inside of the opening of the socket to mechanically hold the probe and socket together when the deadbreak arrestor elbow is forced over the deadbreak bushing.

7. The adapter according to claim 6, further comprising a biasing collar surrounding the socket and increasing holding force from the socket when around the probe.

8. The adapter according to claim 1, wherein the deadbreak arrestor elbow further comprises a lightning arrestor.

9. The adapter according to claim 1, wherein the deadbreak arrestor elbow further comprises a surge arrestor.

10. The adapter according to claim 1, wherein the deadbreak bushing is rated for 600 amperes.

11. An adapter for coupling together a deadbreak bushing and a mating deadbreak arrestor elbow, said adaptor comprising:

a deadbreak probe having a threaded end and a contact end opposite the threaded end thereof; and a socket having a threaded end, a contact end opposite the threaded end thereof and a latching ring groove on an outside circumference of the socket and substantially coterminous with the contact end thereof;

wherein:

the threaded end of the non-loadbreak probe screws into a connector in a deadbreak arrestor elbow, the threaded end of the socket screws into a threaded opening in a deadbreak bushing, when the deadbreak arrestor elbow is placed directly onto the deadbreak bushing and forced thereover, the probe and socket contact ends make electrical connection therebetween, and wherein the latching ring groove fits onto a latching ring at an end of a conical opening of the deadbreak arrestor elbow, whereby the deadbreak bushing and the deadbreak arrestor elbow are thereby mechanically held together.

12. The adapter according to claim 11, further comprising a spring biased electrical contact slideably located in the socket for reducing electrical resistance between the socket and probe when coupled together.

13. The adapter according to claim 11, wherein the probe is smooth for reducing force required when being inserted into the socket.

14. The adapter according to claim 11, wherein the deadbreak arrestor elbow further comprises a lightning arrestor.

15. The adapter according to claim 11, wherein the deadbreak arrestor elbow further comprises a surge arrestor.

16. The adapter according to claim 11, wherein the deadbreak bushing is rated for 600 amperes.

17. A method of coupling together a deadbreak bushing and a mating deadbreak arrestor elbow, said method comprising the step of:

screwing a deadbreak probe into a connector in a deadbreak arrestor elbow;

screwing a deadbreak socket into a threaded opening in a deadbreak bushing; and pushing the deadbreak arrestor elbow directly onto the deadbreak bushing, wherein the deadbreak probe and deadbreak socket make electrical and mechanical connection therebetween.

18. The method according to claim 17, further comprising the step of moving a latching ring groove onto a latching ring at an end of a conical opening of the deadbreak arrestor elbow, whereby the bushing and elbow are thereby mechanically held together.

19. The method according to claim 17, further comprising the steps of providing a slideable electrical contact located inside of the deadbreak socket, and biasing with a spring the slideable electrical contact toward the deadbreak probe for reducing electrical resistance therebetween.

* * * * *